US005806106A

United States Patent [19]

Carter et al.

[11] Patent Number: 5,806,106

[45] Date of Patent: Sep. 15, 1998

[54] LEVER ACTIVATED TOILET SEAT LIFT

[76] Inventors: William J. Carter, Box 571; James David Hodges, R.R.#1, Box 99, both of Keosauqua, Iowa 52565

[21] Appl. No.: 835,800

[22] Filed: Apr. 15, 1997

[51] Int. Cl.[6] ..... A47K 13/10

[52] U.S. Cl. ..... 4/246.1

[58] Field of Search ..... 4/246.1–246.5

[56] References Cited

U.S. PATENT DOCUMENTS

| | | | |
|---|---|---|---|
| 621,790 | 3/1899 | Burger et al. . | |
| 1,276,472 | 8/1918 | Zeen . | |
| 1,505,472 | 8/1924 | Kuno . | |
| 1,863,295 | 6/1932 | Bukovitz . | |
| 2,100,906 | 11/1937 | Lefkowitz . | |
| 2,232,895 | 2/1941 | White . | |
| 2,776,440 | 1/1957 | Miller | 4/246.1 |
| 3,345,650 | 10/1967 | Waters . | |
| 3,417,411 | 12/1968 | Greenwood . | |
| 3,504,385 | 4/1970 | Fields . | |
| 4,584,724 | 4/1986 | Wilson . | |
| 4,649,576 | 3/1987 | Lillie . | |
| 4,803,741 | 2/1989 | Ellison | 4/246.4 |
| 5,404,595 | 4/1995 | Carmel . | |

FOREIGN PATENT DOCUMENTS

| | | | |
|---|---|---|---|
| 2275275 | 8/1994 | United Kingdom | 4/246.1 |

*Primary Examiner*—Charles E. Phillips
*Attorney, Agent, or Firm*—Reid & Priest LLP

[57] ABSTRACT

A seat lifter attachment for a toilet base including a mounting bracket resting on and attached to a rear upper surface portion of said toilet base by clamping action of a toilet seat and a second portion extending downwardly along one side of said toilet base. A first pivot fixedly has an axis extending outwardly from the second portion and a second pivot is mounted on and extends outwardly from the second portion. A pivotal actuator lever arm is mounted for pivotal movement on the second pivot and toilet seat lifter is pivotally mounted on the first pivot for pivotal movement on the second pivot and is engageable with the toilet seat for effecting movement of the toilet seat from a lower horizontal position to a lifted vertical position in response to the pivotal movement of the pivotal actuator lever arm. A displacement motion multiplying drive connection between the actuator lever arm and the pivotable toilet seat lifter causes rotation of the pivotable seat lifter through a rotation displacement approximately double rotation of said actuator lever arm.

3 Claims, 2 Drawing Sheets

LEVER ACTIVATED TOILET SEAT LIFT

BRIEF SUMMARY OF INVENTION

The present invention is directed to an apparatus for effecting the lifting of a toilet seat from its normal horizontal use position to an elevated vertical position in a manner which does not require any contact with the seat by the user. Even more specifically, the subject invention is directed to a self-contained attachment which can be mounted on a toilet base or bowl without any modification of the toilet seat or the toilet bowl. Thus, the subject invention can be an aftermarket installation item usable with an existing toilet seat or can be provided as part of the original toilet assembly at the facility at which the toilet seat and toilet base assembly is fabricated.

The need for avoiding manual contact with a toilet seat and the resultant possibility of contacting disease has long been recognized by those of skill in the art as evidenced by the many patents that have been granted for that purpose. However, the prior art suffers form several disadvantages which are overcome and avoided by the present invention.

One of the main problems with many of the prior known toilet seat lifting devices is that they are complicated and therefore expensive to fabricate and maintain. The examples of such overly complicated devices include U.S. Pat. Nos. 621,790 to Berger et el; U.S. Pat. No. 1,276,472 to Zeen; U.S. Pat. No. 1,505,472 to Kuno, U.S. Pat. No. 1,863,295 to Bukovitz; U.S. Pat. No. 2,100,906 to Lefkowitz, U.S. Pat. No. 2,232,895 to White; U.S. Pat. No. 3,417,411 to Greenwood; U.S. Pat. No. 3,345,650 to Waters; U.S. Pat. No. 3,504,385 to Fields; U.S. Pat. No. 4,584,724 to Wilson; U.S. Pat. No. 4,649,576, to Lillie and U.S. Pat. No. 5,404,595 Carmel.

It should also be noted that many of the prior devices employ foot operated peddles or a like which are positioned on the floor adjacent the toilet in an area highly susceptible to contamination which can be transmitted to the users foot or shoe in an obvious manner.

Yet another disadvantage of some of the prior devices is that they require connection to the floor adjacent to the toilet or to the toilet seat base or in extreme instances such as Lefkowitaz U.S. Pat. No. 2,100,906 modification of the floor of the room in which the toilet is installed. Another disadvantage of other known prior devices is that they are incapable of aftermarket installation and must be incorporated in the toilet assembly at the time of fabrication of the toilet.

Therefore, it is a primary object of the present invention to provide a new and improved toilet seat lifter assembly that can be installed on an existing previously installed toilet with a minimum of difficulty.

The further object of the present invention is to the provision of a new and improved toilet lifter assembly of simplified construction.

Yet another object of the subject invention is the provision of a new and improved toilet seat lifter assembly that is economical to construct and maintain.

A further object of the present invention is the provision of a new and improved toilet seat lifter assembly that is easy to maintain in sanitary condition.

SUMMARY OF THE INVENTION

The foregoing objects are obtained by the preferred embodiment of the invention and obvious variations thereof through the provision of a unitary assembly which is positioned on a toilet bowl by first removing the seat so as to expose the two seat mounting apertures in which the seat retaining threaded lungs are received when the seat is attached to the toilet bowl. The unitary inventive assembly is positioned on the top rear surface of the toilet bowl so that apertures provided in a mounting plate of the assembly are aligned with apertures in the toilet bowl for receiving the threaded studs of the toilet seat which extend downwardly through the mounting plate apertures and the aligned seat mounting apertures in the toilet bowl. Conventional retaining nuts are tightened on the lower ends of the threaded studs so as to clamp the seat and the mounting plate of the unitary inventive assembly in position. When clamped in position, the unitary inventive assembly is ready to operate for the purpose of lifting the toilet seat to a an elevated generally vertical position by operation of an actuator lever arm forming part of the unitary inventive assembly.

The preferred embodiment unitary inventive assembly more specifically comprises a right angle mounting bracket having a horizontal upper plate in which two elongated mounting apertures are provided for alignment with the mounting apertures provided in the upper rear surface toilet bowl base for permitting attachment of the toilet seat to the toilet base. The right angle mounting bracket also includes a vertical downwardly extending actuator support plate which extends downwardly from one end of the horizontal upper plate adjacent one side of the toilet bowl and includes first and second pivot pin receiving apertures. The pivot pin receiving apertures are respectively positioned at different elevations on the actuator support plate and the lowest pivot pin receiving aperture receives a lever supporting pivot pin of an actuator lever arm so that the actuator lever arm is pivotally supported on the lever supporting pivot pin. The upper pivot pin comprises a pivotal seat lifter supporting pivot pin which supports a seat bottom engaging pivotal seat lifter which faces the seat bottom of the toilet seat and extends under the bottom surface of toilet seat.

Additionally, the pivotal seat lifter includes a lost motion movement multiplying slot in which one end of a lever support pivot pin extending from an actuator a lever is received. Pivotal movement of the actuator lever arm from a rearward position in which the toilet seat is in its horizontal down position to a forward position causes the lever support pivot pin to move along the lost motion slot and exert a downward reactive force causing the pivotal seat lifter to pivot in counter clockwise direction as viewed from the side of the toilet bowl of which the actuator lever is located. Such pivotal movement of the pivotal seat lifter causes the seat bottom engaging plate to rotate upwardly against the bottom of toilet seat and pivot the toilet seat from its horizontal down position to its vertical raised position without there being any need for manual touching or contact with the toilet seat. The arrangement of parts is such that the pivotal travel of the actuator lever arm is approximately half the approximately 90° movement of the toilet seat. The only item requiring engagement by the user of the apparatus is the actuator lever arm. A better understanding of the operation of the preferred embodiment will be achieved when the following more specific description is considered in conjunction with the appended drawings.

Figure 2:
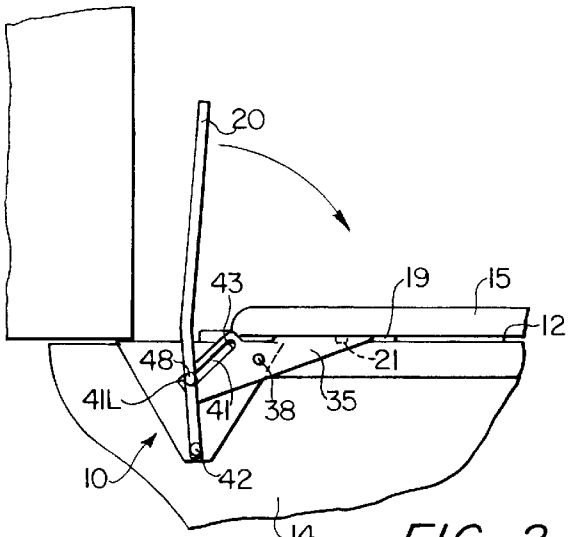
FIG. 2 is a side elevation view of the preferred embodiment as installed on a toilet with the toilet seat being in a lower horizontal position.
Figure 3:
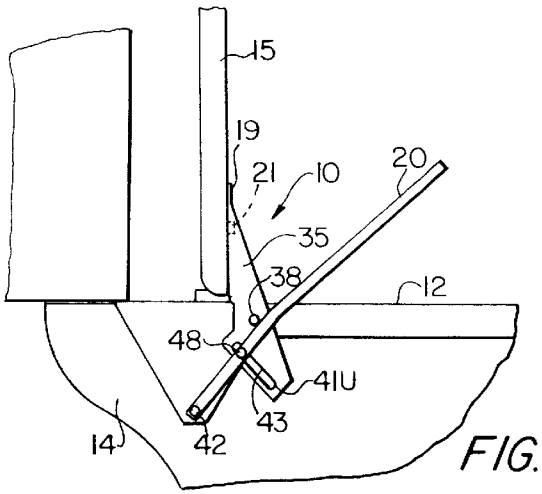
FIG. 3 is similar to FIG. 2 but illustrates the position of the components of the third embodiment assumed as a consequence of movement of the lever arm from its FIG. 2 position to effect pivotal movement of the toilet seat to its raised vertically orientated position.
Figure 1A:
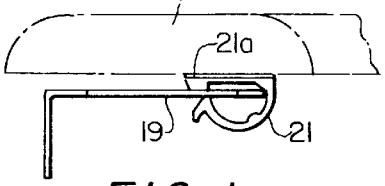
FIG. 1*a* is a side elevation illustrating clip means employed for returning the toilet seat to its lowered position.
Figure 1:
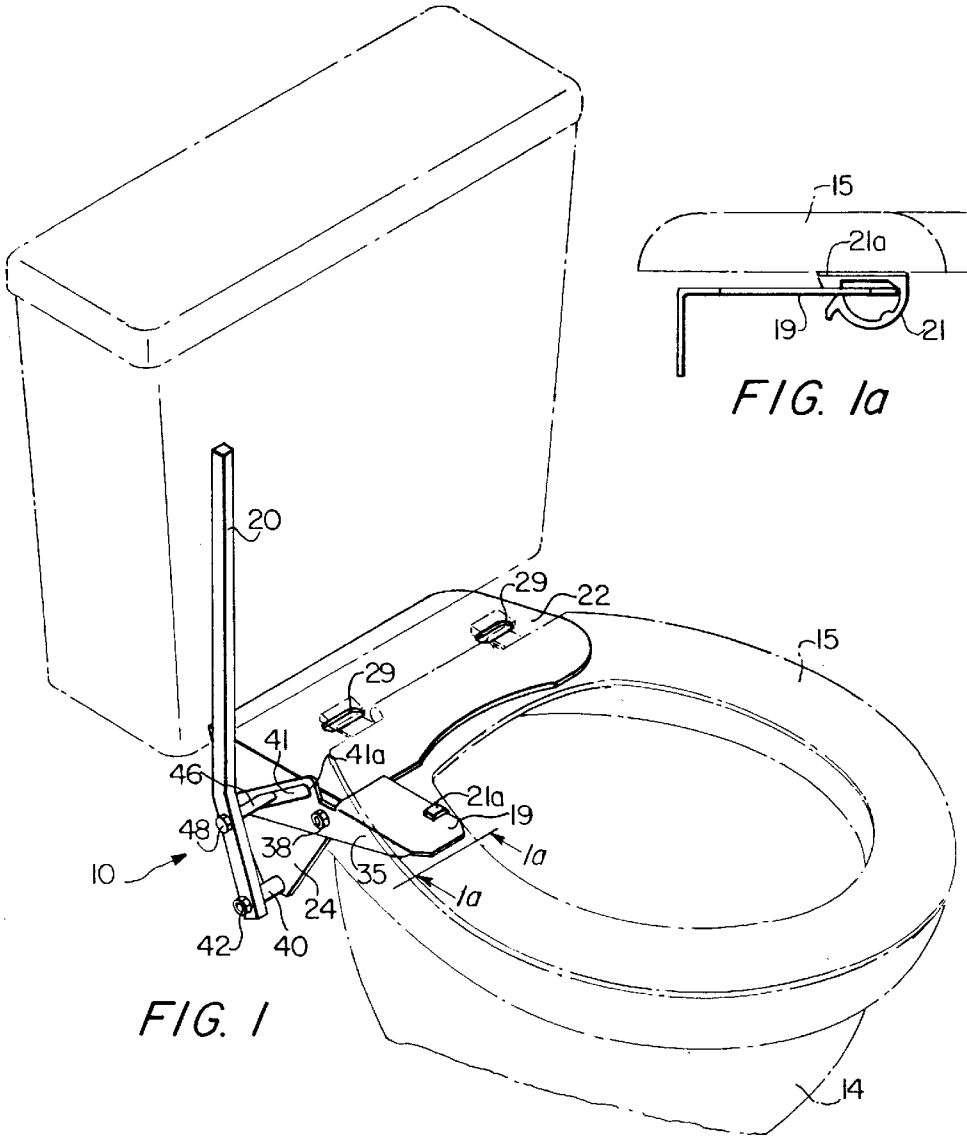
FIG. 1 is a perspective view illustrating the preferred embodiment of the invention as installed on a toilet which is illustrated in phantom (dashed) lines.

The preferred embodiment, generally designated 10, is an assembly mounted on the upper surface of 12 of a toilet bowl 14 as shown in FIGS. 1, 2 and 3. The preferred embodiment comprises a unitary assembly of three major components—namely, a right angle mounting bracket 16, a pivotal seat lifter 18 and a pivotal actuator lever arm 20, as best shown in FIG. 4.

More specifically, the right angle mounting bracket comprises a horizontal attachment plate 22 and a vertical actuator support plate 24, formed of a unitary metal plate member. The horizontal attachment plate 22, includes first and second elongated mounting slots 26 and 28 which are dimenioned and shaped so that they can be positioned over the well-known conventional seat mounting apertures provided in the top of a conventional toilet base 14 for receiving the threaded studs (not shown) of a conventual toilet seat which extend downwardly from hinge bases 29 of the toilet seat through the seat mounting apertures in the toilet base. A threaded nut (not shown) is threaded on each threaded stud and tightened to hold the toilet seat and attachment plate 22, which is sandwiched between the hinge bases 29 and the top surface of the toilet seat base, in a fixed manner on the toilet seat base.

Figure 4:
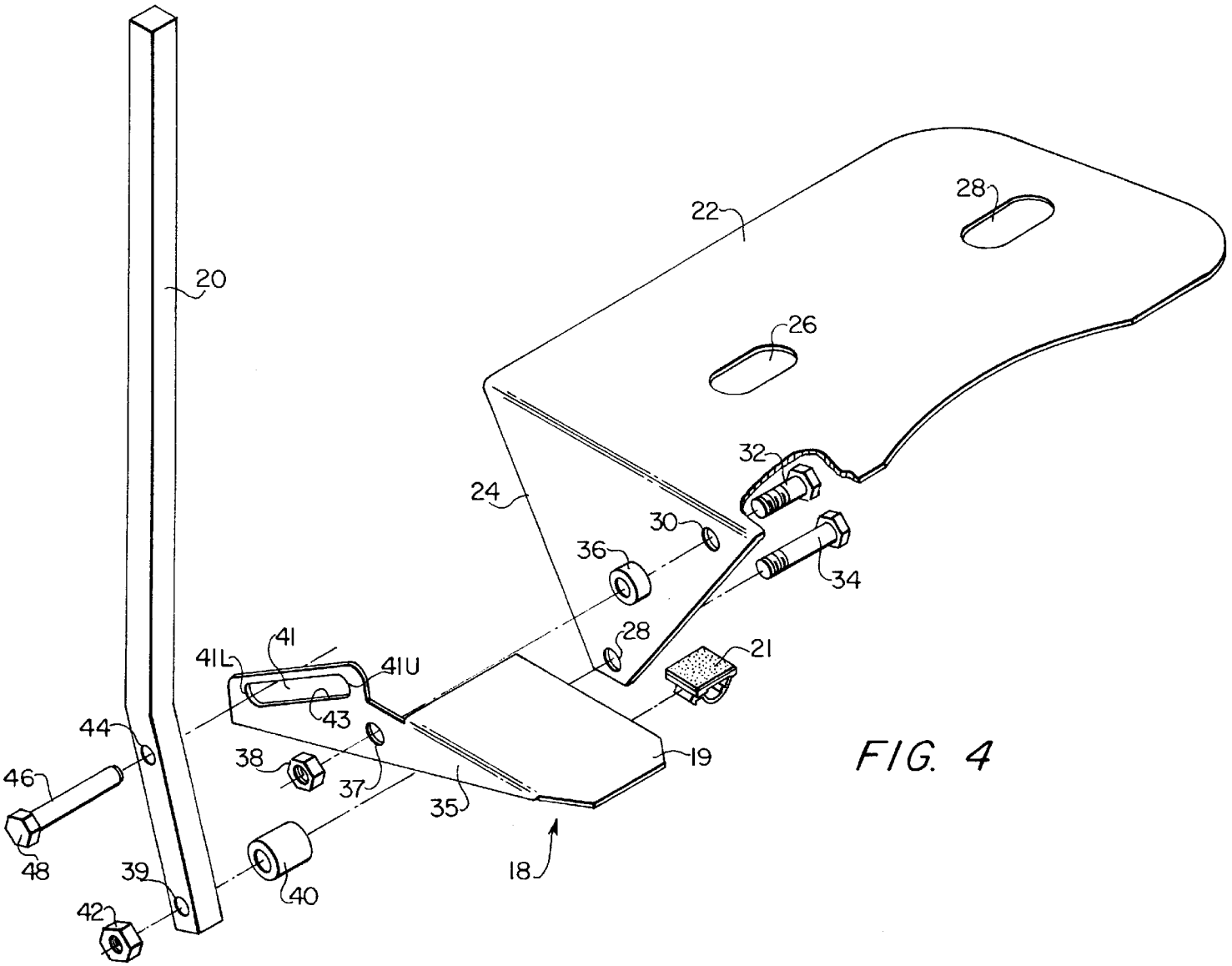
FIG. 4 is an exploded perspective view of the preferred embodiment of the invention.

Pivotal seat lift member 18 includes a seat bottom engaging plate 19 and a side plate 35 with the seat bottom engaging plate 19 and the side plate 35 being formed of at unitary metal plate bent and formed to the shape shown in FIG. 4. Additionally, a plastic clip 21 having a pressure sensitive adhesive pad 21 a fixedly secured to its upper surface is fixedly clamped in position on plate 19 as shown in FIGS. 1 and 1*a* with the adhesive pad 21*a* facing upwardly so as to be engageable with the bottom of toilet seat 15 to be secured thereto. A seat lifter pivot aperture 37 is formed inside plate 35 and a motion multiplier follower slot 41 having an upper end 41U and a lower end 41L is also provided in side plate 35.

Interconnection of the main component parts, right angle mounting bracket 16, pivotal seat lifter 18 and pivotal actuator arm 20, is effected by a seat lifter supporting pin 32, a lever supporting pivot pin 34 and a drive pin 46. Pivotal actuator arm 20 is provided with a lever support pivot aperture 39 and a drive pin aperture 44. A seat lifter supporting pin 32 extends through upper pivot pin receiving aperture 30 provided in the vertical actuator support plate 24 and through the seat lifter pivot aperture 37 provided in side plate 35. A spacer 36 is provided between side plate 35 and the facing surface of the vertical actuator support plate 24 with a retaining nut 38 being threaded on the outer end of seat lifter supporting pin 32 for holding the pivotal seat lifter 18 in position for pivotal movement about the axis of seat lifter supporting pin 32.

Additionally, supporting pivot pin 34 extends through the lower aperture 28 in vertical actuator support plate 24 into the lever pivot aperture 39 provided at the lower end of pivotal actuator lever arm 20. A retainer nut 42 is screwed on to the threads on the outer end of the lever supporting pin 34. Spacing between the side plate 35 of pivotal seat lifter 18 and the facing surface of lever 24 is provided by a relatively elongated spacer member 40.

A drive pin 46 extends through the drive pin aperture 44 in lever 20 into and through the motion multiplier follower slot 41 in side plate 35. Drive pin 46 has a head 48 which is welded, or otherwise secured, to pivotal actuator lever arm 20 for retaining the drive pin 46 in position on pivotal actuator lever arm 20. Optionally, a threaded nut or other connector could also be used for this purpose.

Attachment of the preferred embodiment to the toilet bowl is easily effected by first removing the toilet seat from the bowl and positioning the horizontal attachment plate 22 on the upper surface of the bowl with apertures 26 and 28 in plate 22 being aligned with the vertical toilet seat mounting apertures (not shown) provided in the upper surface 12 of the bowl in well known manner. The toilet seat is then repositioned so that its conventional mounting lugs (not shown) extend downwardly through the apertures 26 and 28 and the aperture in the toilet seat bowl following which the retaining nuts are positioned and tightened on the retaining lugs of the toilet seat so as to clamp the horizontal aperture attachment plate 22 in position on the upper surface 12 of the toilet bowl. The installation is completed by pressing the adhesive pad 21*a* against the bottom surface of the tolet seat 15.

When the handle is in the position shown in FIG. 2, the toilet seat 15 is in the horizontal lower position and the drive pin 46 is in the lower end 41L of motion multiplying follower slot 41. Clockwise rotational movement of handle 20 in the direction of the arrow in FIG. 2 causes drive pin 46 to move upwardly along motion multiplier follower slot 41 to consequently pivot the pivotal seat lifter 18 counter-clockwise about pivot pin 32 from the position shown in FIG. 2 to the intermediate position shown in FIG. 3 so as to effect raising of the seat 20 to its elevated position. Further movement of handle 20 moves pin 48 toward end portion 41U of slot 41 which results in locking of the seat in its elevated positions. The arrangement is such that an initial approximately 45 degree pivotal movement of the pivotal actuator lever arm 20 to the position shown in FIG. 3 results in at least a 90 degree pivotal movement of the seat 15 in a counter clockwise direction. It is significant that pin 48 goes "over center" when it crosses the line between the centers of pins 46 and 32 so that the toilet seat cannot be manually moved downwardly from its elevated position of FIG. 3 since such movement is prevented by engagement of pin 48 with the upper, as viewed in FIG. 3, side 43 of slot 41 in the end portion 41U of the slot. Therefore, lowering of toilet seat can only be effected by reverse movement of the pivotal actuator lever arm 20 in a counter clockwise direction to the position shown in FIG. 2. The adhesive pad 21*a* connection to the bottom surface of the toilet seat 15 insures movement of the seat.

Therefore, it will be appreciated that the present invention is directed to a remarkable, simple and effective construction which can be attached to a wide variety of previously installed toilet seats with a minimum of difficulty. Moreover, operation of the subject invention is easily effected without great effort usable by children, infirm persons or others of limited strength.

Numerous modifications of the preferred embodiment as disclosed here will be obvious to those with skill in the art. For example, the parts can be made of molded plastic rather than metal and the pivotal supports and drive connections could be reversed without departing from the spirit and scope of the invention. Also, the use of clip member 21 is optional and its use is not essential to the operation of the invention. Therefore it should be understood that the spirt and scope of the invention is to be limited solely by the appended claims.

We claim:

1. In a toilet including a toilet base having an upper surface and a toilet seat hingedly mounted on said toilet base, a mounting bracket resting on and attached to a rear upper surface portion of said toilet base by a first portion and having a second portion extending downwardly along one side of said toilet base, first pivot means fixedly positioned on said mounting bracket and having an axis extending outwardly therefrom, a second pivot means mounted on and extending outwardly from said mounting bracket, a toilet seat actuator lever arm mounted for pivotal movement on said second pivot means, a pivotable seat lifter pivotally mounted on said first pivot means for pivotal movement about the axis of said first pivot means and including a portion engageable with said toilet seat for effecting movement of said toilet seat from a lower horizontal position to a lifted vertical position in response to the pivotal movement of said pivotal seat lifter in a first direction and a displacement motion multiplying drive connection between said actuator lever arm and said pivotable seat lifter for rotating said pivotable seat lifter in said first direction through a rotational displacement in said first direction in response to pivotal rotation of said actuator lever arm through a rotational displacement that is less than the rotational displacement of said toilet seat lifter, wherein said first and second portions of said mounting bracket are perpendicular to each other, said first portion of said mounting bracket includes aperture means alignable with apertures provided in said toilet seat base provided for receiving mounting studs of said toilet seat and wherein said motion multiplying means includes an elongated slot in said pivotal seat lifter and a drive member extending from said actuator lever arm into said slot for providing a driving connection therewith for effecting pivotal movement of said pivotal seat lifter, and said pivotal seat lifter comprises a vertical plate in which said elongated slot is provided and wherein said portion engageable with said toilet seat comprises a plate member oriented perpendicularly to said vertical plate.

2. The combination of claim 1 wherein said first pivot pin extends through an opening in said vertical plate to provide pivotal support for said pivotal seat lifter.

3. A toilet attachment device for permitting hand lever actuated movement of a toilet seat having hinge means for permitting movement of the toilet seat from a lower position to a raised portion for use on toilets of the type employing seat mounting apertures in a toilet bowl for receiving threaded studs of the toilet seat for effecting attachment of the toilet seat to the toilet bowl, said attachment comprising:

(A) a mounting bracket including an attachment plate having mounting aperture means alignable with the seat mounting apertures of the toilet bowl for enabling mounting of the attachment device on the upper surface of the toilet bowl beneath the toilet seat hinge means below which mounting studs extend for positioning in the seat mounting apertures and actuator support means connected to said attachment plate;

(B) a pivotal seat lifter mounted for pivotal movement between a lowered position and an elevated position on said actuator support means including a seat bottom engaging means positioned to be engageable with a toilet seat attached to a toilet bowl in the manner described;

(C) a pivotal actuator lever arm mounted for pivotal movement on said actuator support means for pivotal movement between first and second positions;

(D) a drive connection between said actuator lever arm and said pivotal seat lifter for pivoting said pivotal seat lifter in response to movement of said pivotal actuator lever arm so that said seat bottom engaging means moves in a direction for engaging and lifting a toilet seat when the toilet seat lifting attachment device is mounted on a toilet by said attachment plate in the manner described in paragraph (A);

(E) wherein said actuator support means comprises a vertical actuator support plate extending downwardly from said attachment plate;

(F) wherein said vertical actuator plate is substantially perpendicular to said attachment plate and extends unitarily from said attachment plate; and (G) wherein said pivotal seat lifter includes a vertically oriented side plate which is unitarily formed with said seat bottom engaging plate and is unitarily formed therewith of a single sheet of material.

* * * * *